US008915202B2

(12) United States Patent
Hall et al.

(10) Patent No.: US 8,915,202 B2
(45) Date of Patent: Dec. 23, 2014

(54) LOOPER MODULE FOR TUFTING CHAIN-STITCH FABRICS

(71) Applicant: Card-Monroe Corp., Chattanooga, TN (US)

(72) Inventors: Wilton Hall, Ringgold, GA (US); Todd Woodall, Soddy Daisy, TN (US)

(73) Assignee: Card-Monroe Corp., Chattanooga, TN (US)

( * ) Notice: Subject to any disclaimer, the term of this patent is extended or adjusted under 35 U.S.C. 154(b) by 13 days.

(21) Appl. No.: 13/826,264

(22) Filed: Mar. 14, 2013

(65) Prior Publication Data

US 2014/0245938 A1 Sep. 4, 2014

Related U.S. Application Data

(60) Provisional application No. 61/771,334, filed on Mar. 1, 2013.

(51) Int. Cl.
*D05C 15/22* (2006.01)
*D05C 15/04* (2006.01)

(52) U.S. Cl.
CPC ..... *D05C 15/22* (2013.01)
USPC ..... 112/475.23; 112/80.5

(58) Field of Classification Search
CPC ..... D05C 15/00; D05C 15/04; D05C 15/08; D05C 15/20; D05C 15/22
USPC ..... 112/80.5–80.54, 475.18, 475.23
See application file for complete search history.

(56) References Cited

U.S. PATENT DOCUMENTS

| | | | | |
|---|---|---|---|---|
| 2,562,939 | A | | 7/1951 | Noe |
| 2,750,772 | A | | 6/1956 | Bellini |
| 2,800,096 | A | | 7/1957 | Signoret |
| 2,889,791 | A | | 6/1959 | Fedevich |
| 3,075,482 | A | * | 1/1963 | Card ..... 112/80.51 |
| 3,401,657 | A | | 9/1968 | Watkins |
| 3,402,686 | A | * | 9/1968 | Rodstein et al. ..... 112/80.43 |
| 3,421,929 | A | | 1/1969 | Watkins |
| 3,485,195 | A | | 12/1969 | Torrence |
| 3,618,542 | A | | 11/1971 | Zocher |
| 3,618,544 | A | * | 11/1971 | Watkins ..... 112/80.52 |
| 3,626,878 | A | * | 12/1971 | Cobble ..... 112/80.52 |
| 3,757,709 | A | | 9/1973 | Cobble |
| 3,780,678 | A | | 12/1973 | Short |

(Continued)

FOREIGN PATENT DOCUMENTS

| | | |
|---|---|---|
| DE | 2004726 | 8/1971 |
| GB | 1335906 | 4/1971 |
| GB | 2104925 | 6/1982 |
| WO | WO 90/06391 | 6/1990 |

*Primary Examiner* — Ismael Izaguirre

(74) *Attorney, Agent, or Firm* — Womble Carlyle Sandridge & Rice LLP

(57) ABSTRACT

A looper module for tufting machines in which loop pile tufts of yarns are formed in a backing material in a chained stitch formation includes a module body. The module body generally includes slotted openings in which a series of looper assemblies are received, and further can include a looper support section that projects upwardly from the module body. Each looper assembly can include a primary looper having loop pile looper and pattern looper portions. First and second transfer loopers are attached to the body of the primary looper and generally can include throat portions extending toward the primary looper for the transfer of loops of yarns thereto.

19 Claims, 6 Drawing Sheets

(56) References Cited

U.S. PATENT DOCUMENTS

| | | | | | |
|---|---|---|---|---|---|
| 3,878,800 | A | * | 4/1975 | Collier et al. | 112/80.53 |
| 4,138,956 | A | | 2/1979 | Parsons | |
| 4,155,319 | A | * | 5/1979 | Short | 112/80.51 |
| 4,170,949 | A | | 10/1979 | Lund | |
| 4,175,497 | A | | 11/1979 | Lund | |
| 4,195,580 | A | | 4/1980 | Hurst | |
| 4,285,286 | A | * | 8/1981 | Hash | 112/80.53 |
| 4,303,024 | A | | 12/1981 | Bardsley | |
| 4,313,388 | A | | 2/1982 | Biggs et al. | |
| 4,368,679 | A | * | 1/1983 | Hash | 112/80.52 |
| 4,419,944 | A | | 12/1983 | Passons et al. | |
| 4,528,921 | A | | 7/1985 | Slattery | |
| 4,559,885 | A | | 12/1985 | Card et al. | |
| 4,574,716 | A | | 3/1986 | Czelusniak, Jr. | |
| 4,587,914 | A | | 5/1986 | Card et al. | |
| 4,608,934 | A | | 9/1986 | Card et al. | |
| 4,637,329 | A | | 1/1987 | Czelusniak, Jr. | |
| 4,667,611 | A | | 5/1987 | Yamamoto et al. | |
| 4,669,171 | A | | 6/1987 | Card et al. | |
| 4,691,646 | A | | 9/1987 | Card et al. | |
| 4,693,191 | A | | 9/1987 | Card et al. | |
| 4,739,717 | A | | 4/1988 | Bardsley | |
| 4,841,886 | A | | 6/1989 | Watkins | |
| 6,014,937 | A | | 1/2000 | Lovelady | |
| RE37,108 | E | | 3/2001 | Neely | |
| 6,605,251 | B1 | | 8/2003 | Vidarsson | |
| 6,886,477 | B2 | | 5/2005 | Vaughan et al. | |
| 7,438,007 | B1 | | 10/2008 | Hall | |
| 7,490,566 | B2 | | 2/2009 | Hall | |
| 7,597,057 | B2 | | 10/2009 | Johnston et al. | |
| 7,739,970 | B2 | | 6/2010 | Hall | |
| 7,946,233 | B2 | | 5/2011 | Hall et al. | |

* cited by examiner

LOOPER MODULE FOR TUFTING CHAIN-STITCH FABRICS

CROSS REFERENCE TO RELATED APPLICATIONS

The present Patent Application is a formalization of previously filed U.S. Provisional Patent Application Ser. No. 61/771,334, filed Mar. 1, 2013 by the inventors named in the present Application. This Patent Application claims the benefit of the filing date of this cited Provisional Patent Application according to the statutes and rules governing provisional patent applications, particularly 35 U.S.C. §119(a)(i) and 37 C.F.R. §1.78(a)(4) and (a)(5). The specification and drawings of the Provisional Patent Application referenced above are specifically incorporated herein by reference as if set forth in their entireties.

FIELD OF THE INVENTION

The present invention generally relates to the formation of tufted articles such as carpets, and in particular to a looper module and method of forming tufts of yarns in a backing material to form chain-stitch or "perma-stitch" tufted articles such as carpets.

BACKGROUND OF THE INVENTION

It has been known in the field of tufting carpets to form carpets with a variety of different pattern effects. For example, it has been known to tuft cut and loop pile tufts of yarns in the same carpet patterns, including formation of cut pile and loop pile tufts in the same longitudinal tuft rows, and to control yarn feed mechanisms of tufting machines, including roll, scroll, and single-end type yarn feed attachments, to form various high/low tufted pattern effects. As decorating styles and customer preferences change, such changes bring demands for new patterns and new looks to carpets and other tufted fabrics. This includes demands for improved and sharper, more precise designs in known type/style carpets.

For example, "perma-stitch" style carpets, in which the carpets are tufted with a series of loop pile tufts arranged in a chain-stitch configuration or pattern, previously have been developed, such as disclosed and illustrated in U.S. Pat. No. 4,285,286. One problem with forming such perma-stitch or chained loop pile carpets has been maintaining consistency in the chain-stitch formation, especially as tufting machine speeds have increased. If a loop or link in the chain of stitches is missed, it can create a significant pattern defect. As a result, such chain-stitch or perma-stitch fabrics traditionally have been run at lower tufting machine speeds than conventional cut or loop patterns so that such consistency of formation of the stitches in the chain can be accurately monitored. Additionally, conventional chain-stitch forming systems also generally require specially designed loopers which, due to the tufting operations for forming chain-stitch tufted patterns, can be subjected to increased wear, especially at faster machine speeds.

Accordingly, it can be seen that a need exists for a system and method for forming chain-stitch tufted articles that address the foregoing and other related and unrelated problems in the art.

SUMMARY OF THE INVENTION

Briefly described, the present invention generally relates to an improved looper or hook module and a system for tufting chain-stitch type fabrics in which a series of stitches or tufts of yarns are formed in a chained or interlocked pattern or configuration in a backing material as the backing material is passed through the tufting zone of a tufting machine. In one embodiment, the looper or hook module can include a module body mountable along a looper drive system of the tufting machine, and in which a series of chain-stitch looper assemblies for forming chain-stitch tufted articles are received. The module body generally is formed with a main body portion having an upper surface in which a series of horizontal slots or openings are formed at spaced intervals therealong, and a looper support along one side of the module body, extending upwardly from the main body portion and having a series of corresponding looper support openings or slots that are substantially aligned with the horizontal openings or slots of the main body portion. Each of the looper assemblies will be received within the slots or openings formed in the main body portion of the module, with loop pile loopers thereof further being received and supported in corresponding slots of the looper support of the module. Each looper assembly can be releasably secured within its module body by an insert received within the module body and which can be engaged by one or more set screws received through the module body.

In one embodiment, each looper assembly received within the looper modules generally can include a primary or main looper, and first and second transfer loopers. Each primary looper generally will have a body, which can be of an increased thickness and which includes a lower body portion or shank and an upper body portion. The upper body portion of each primary looper can include a loop pile looper having a loop pile looper throat, and a pattern looper spaced from the loop pile looper and having a pattern looper throat generally extending in a direction parallel to the loop pile looper throat. The first and second transfer loopers each generally can include substantially C- or U-shaped bodies and can be mounted to or adjacent the upper body portion of the primary looper.

The first transfer looper can be formed as a stationary looper having a lower portion that is mounted or attached to the primary looper by one or more fasteners, as well as being attached to the pattern looper portion of the primary looper adjacent its upper end by an additional fastener. The second transfer looper can be formed as an elastic or moveable transfer looper, with its body having a lower portion affixed to the upper body portion of the primary looper, such as by the same fasteners that attach the lower portion of the first or stationary transfer looper to the primary looper. The second or elastic transfer looper also can have an upper portion with an expanded or offset configuration that is spaced from the primary looper and which upper portion generally can remain unattached so as to be able to flex and move with respect to the primary looper. Each of the first and second transfer loopers further generally will include a transfer looper throat having an inwardly projecting configuration that extends toward the loop pile looper throat of the primary looper. The configuration of the first and second transfer loopers further defines a pocket or window opening for consistent passage and movement of the needles into and out of engagement with the loop pile loopers of the primary loopers for pickup of the yarns therefrom.

As the looper assemblies are driven during operation of the tufting machine, the loop pile loopers of each of the looper assemblies will engage their corresponding needles for forming loops of yarns along their loop pile looper throats. These loops of yarns thereafter are transferred from the loop pile looper throat to the throats of the transfer loopers as the module is reciprocated by its drive mechanism and the needles are retracted from the backing material. Thereafter, as a next cycle progresses, the transfer loopers spread the loops of yarns apart to enable the needles to pass therethrough for pickup of a next loop of yarns from the needles for the next stitch to be formed, resulting in the formation of a chain of loops or stitches. The movement or flexing of the elastic or second transfer loopers further enables the needles to pass out of engagement without binding or otherwise interfering with the movement of the needles out of engagement with the loop pile loopers of the primary loopers. At the same time, additional pattern loops or tufts can be formed by engagement of a second set or row of needles, which can be mounted along a single needle bar at a predetermined stagger from the first row of needles, or can be provided along a second needle bar, for forming additional pattern features within the chain-stitch fabric. Thus a single needle bar with one or more rows of needles or two staggered rows of needles, or multiple needle bars can be used, with the needle bars further being shiftable as needed or desired to form additional varying pattern effects.

Various features, advantages and objects of the present invention will become apparent to those skilled in the art upon a review of the following detailed description, when taken in conjunction with the accompanying drawings.

Various aspects of the present invention may be set forth or apparent from consideration of the following detailed description, when taken in conjunction with the accompanying drawings. Moreover, it will be understood that the accompanying drawings, which are included to provide a further understanding of the present disclosure, are incorporated in and constitute a part of this specification, illustrate various aspects, advantages and benefits of the present disclosure, and together with the detailed description, serve to explain the principles of the present disclosure. In addition, those skilled in the art will understand that, according to common practice, various features of the drawings discussed below are not necessarily drawn to scale, and that dimensions of various features and elements of the drawings may be expanded or reduced to more clearly illustrate the embodiments of the present disclosure.

DETAILED DESCRIPTION OF THE INVENTION

Figure 1:
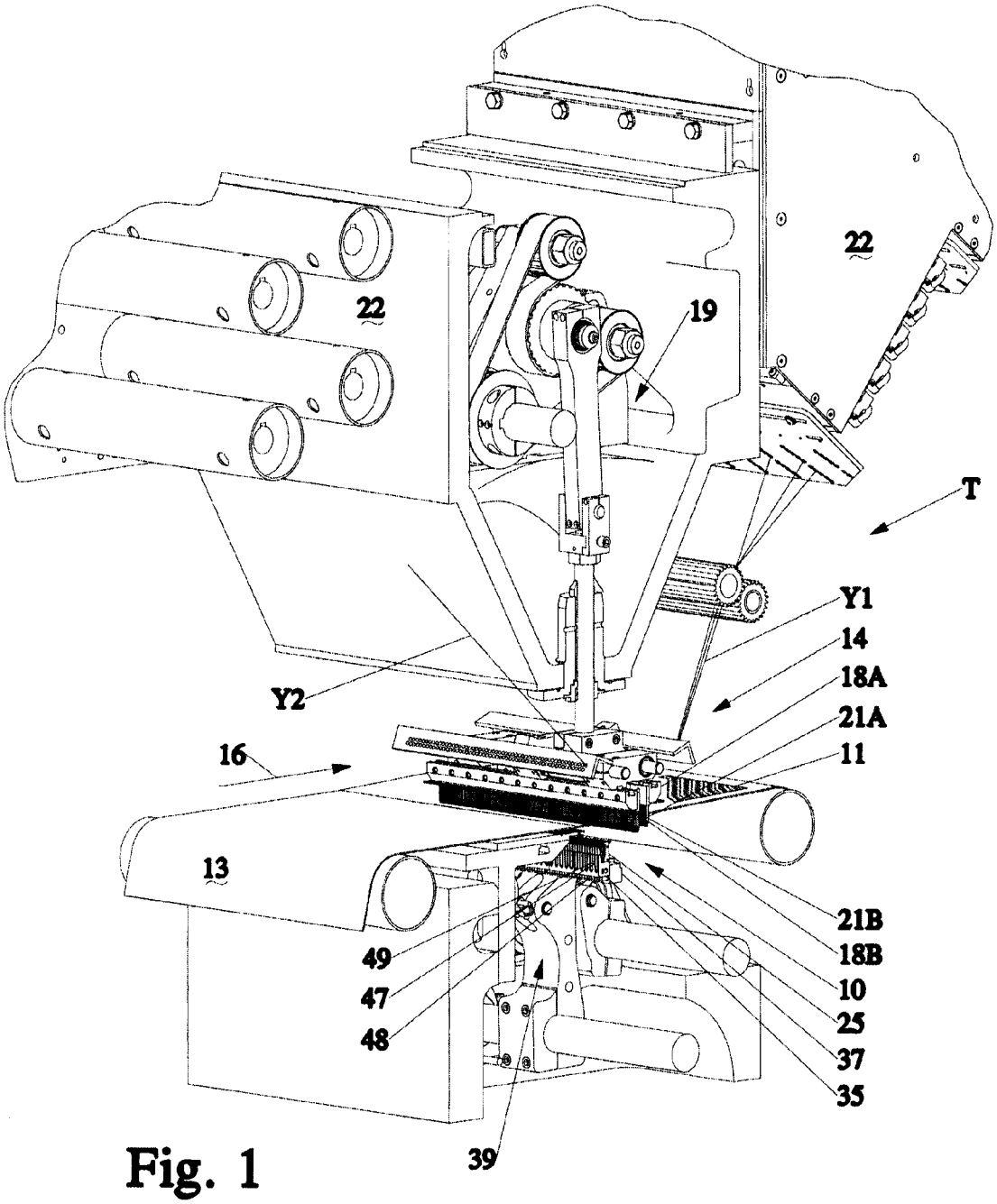
FIG. 1 is a perspective illustration schematically illustrating a tufting machine incorporating a looper module for forming chain-stitch fabrics according to the principles of the present invention.
Figure 2:
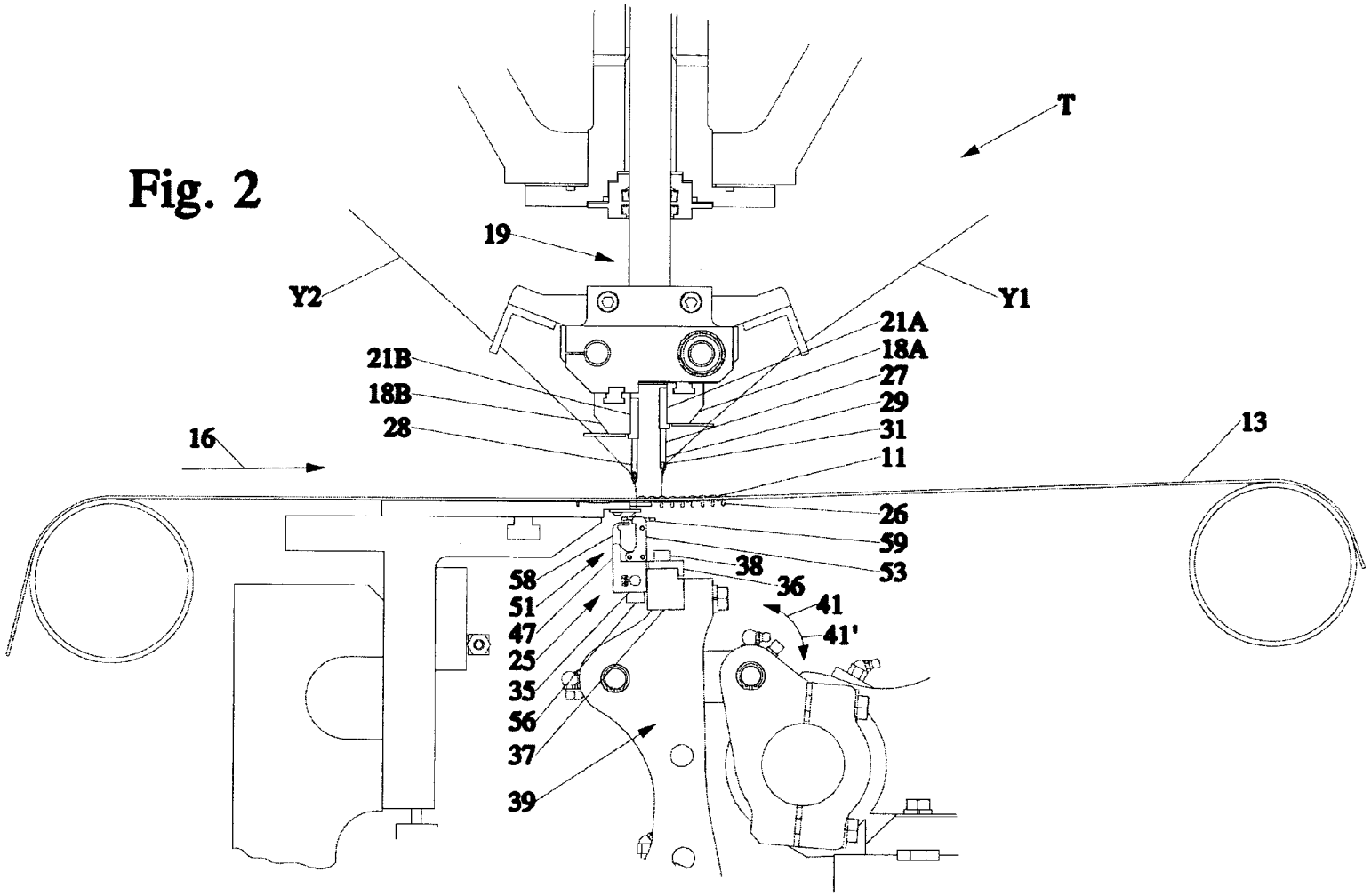
FIG. 2 is a side elevational view schematically illustrating the tufting zone of the tufting machine of FIG. 1.
Figure 3:
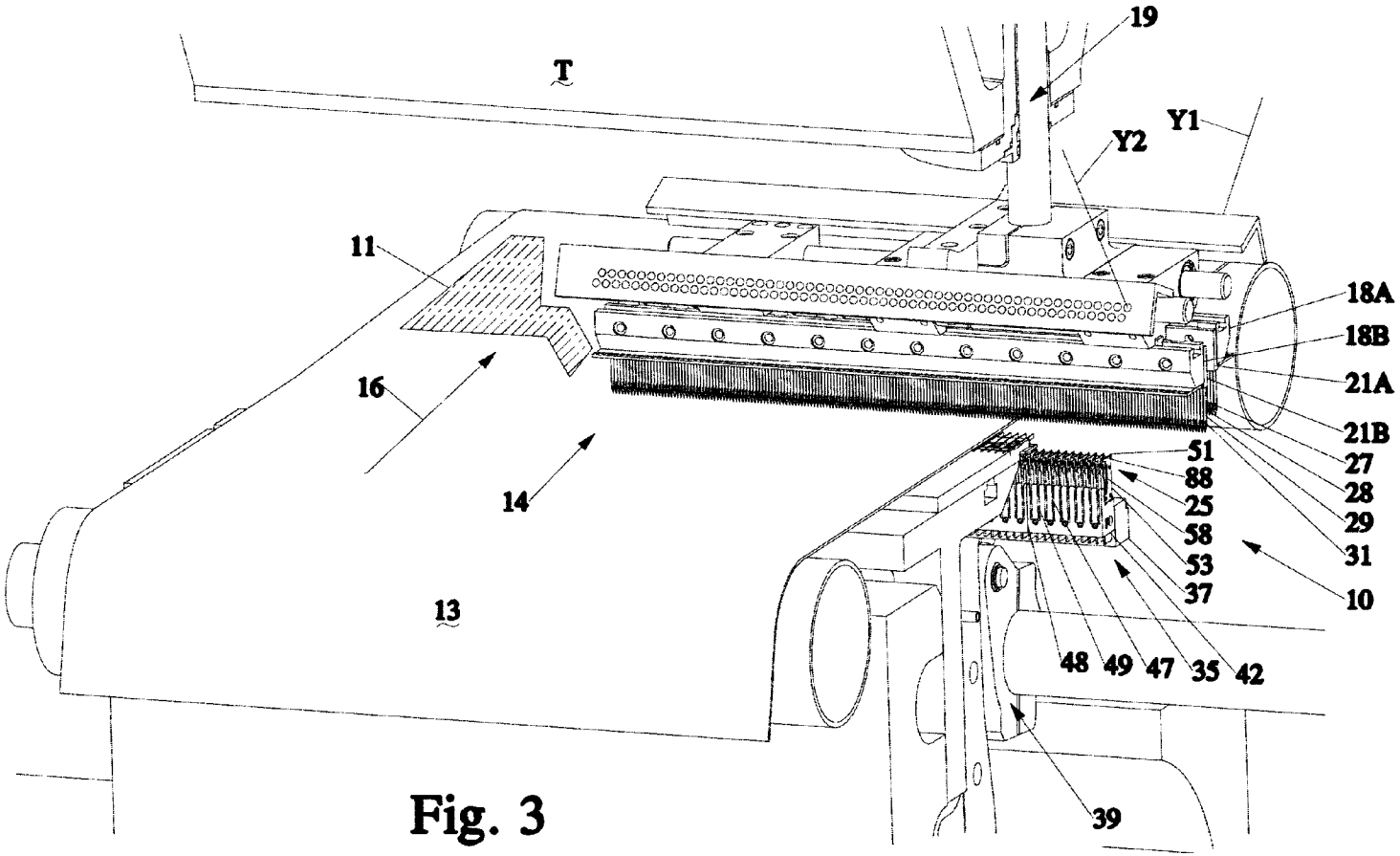
FIG. 3 is a perspective illustration showing the movement of a series of needles mounted along a needle bar moving toward engagement with the looper module for forming chain-stitch fabrics according to the principles of the present invention.
Figure 4A:
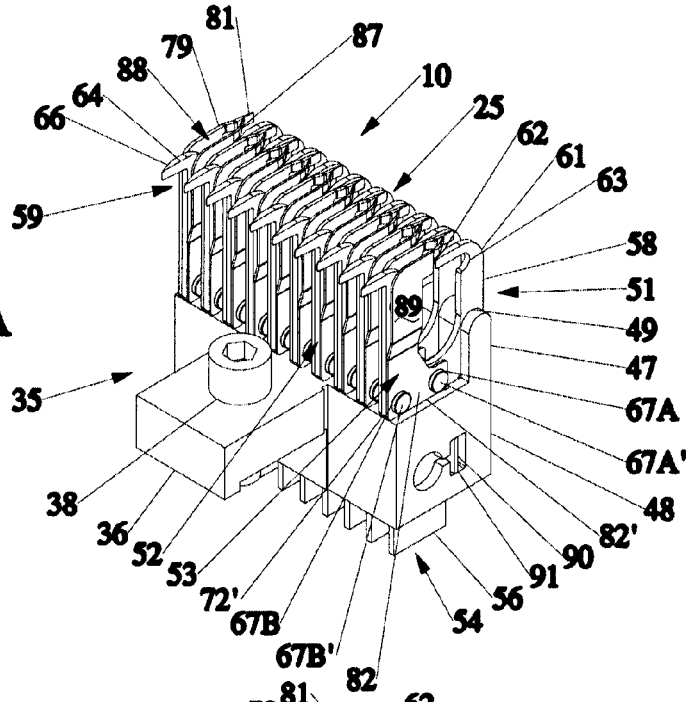
FIG. 4A is a perspective illustration of one embodiment of a looper module including a chain-stitch looper assembly according to the principles of the present invention.
Figure 4B:
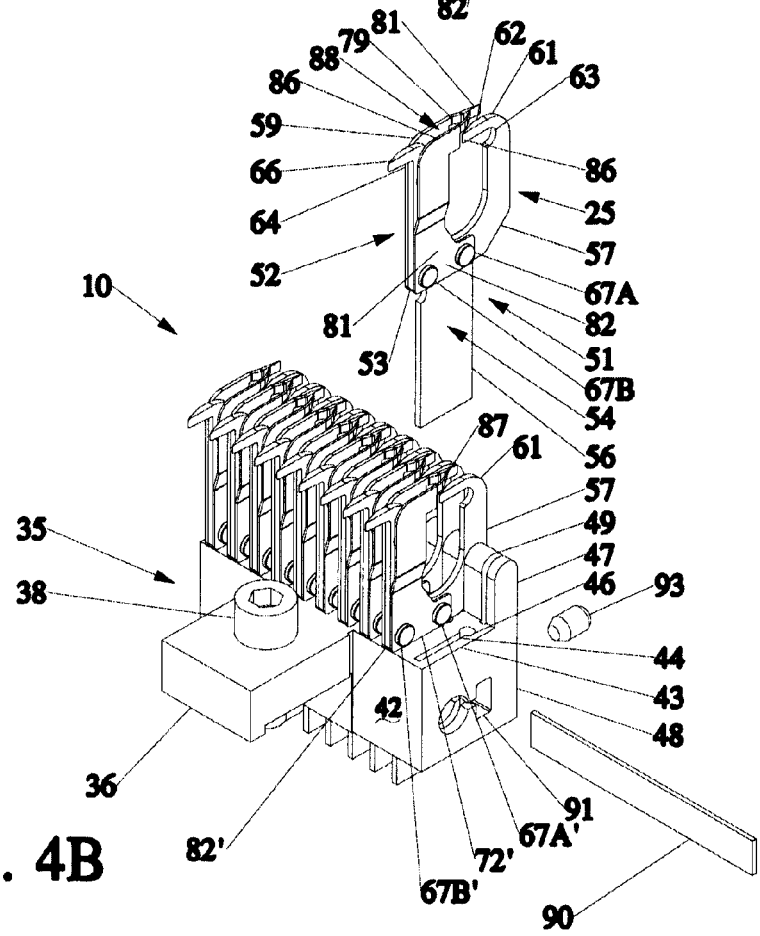
FIG. 4B is a perspective illustration of the looper module of FIG. 4A, illustrating the mounting of a chain-stitch looper assembly therein.

Referring now in greater detail to the drawings in which like numerals indicate like parts throughout the several views, in one embodiment, the present invention generally relates to a chain-stitch looper or hook module 10 for use in a tufting machine T for form tufted articles such as carpets or similar fabric materials, having a series of chained stitches or tufts of yarns formed in interlocking series, such as illustrated at 11 in FIGS. 1-3, in a backing material 13 as the backing material is fed through a tufting zone 14 of the tufting machine T along a path of travel such as indicated by arrow 16. FIGS. 1-3 generally illustrate an example embodiment of the tufting machine T incorporating looper modules 10 having a series of looper or hook assemblies as shown in FIGS. 4A-4B for forming chain-stitch tufted articles.

As generally illustrated in FIGS. 1-3, the tufting machine T generally will include one or more needle bars 18A/18B driven by a reciprocating drive system 19 and which can each include a series of spaced needles 21A and 21B mounted in spaced series therealong. The needles 21A and 21B carry a series of yarns Y1 and Y2, which are fed from a yarn feed mechanism 22, such as a roll, scroll, single end, double end or other type of yarn feed mechanism, such as, for example, an Infinity IIE yarn feed mechanism as manufactured by Card-Monroe Corp., for controlling the feeding of the yarns Y1 and Y2 to the needles 21A and 21B, as indicated in FIG. 1.

Although FIGS. 1-3 generally illustrate the use of the present invention in a tufting machine having a pair of needle bars 18A and 18B, each including a single row of needles 21A and 21B being carried thereby. However, it will be understood by those skilled in the art that the present invention also can be utilized with tufting machines T that include single needle bars carrying single or multiple rows of spaced needles therealong, with the needles being arranged inline or spaced according to a predetermined stagger or gauge, as needed or desired, and with the number of needles generally depending on the size and gauge of the tufting machine. In addition, the needle bar or needle bars 18A/18B can be shiftable needle bars that are shifted transversely across the tufting zone 14 by a shift mechanism (not shown), such as a cam, servomotor or other shift mechanism such as a Smart Step™ shifter mechanism as produced by Card-Monroe Corp. As also will be understood by those skilled in the art, the needle bars generally will be driven by the drive system 19 in a vertically reciprocal motion or stroke between a raised, non-engaging position wherein the needles are out of the backing material or fabric 13, such as indicated in FIGS. 2 and 3, and a lowered, engaging position such as indicated in FIG. 1, in which the needles penetrate the backing material to a depth sufficient to be engaged by the looper or hook assemblies 25 of each of the looper or hook modules 10 so as to pick up and pull loops 26 of yarns therefrom to form the chain-stitch tufts 11 in the backing material 13.

As generally indicated in FIGS. 2 and 6-7B, each of the needles 21A/21B generally will include an elongated body 27 having a channel or guide portion 28 (FIGS. 2 and 6) that terminates in a pickup or takeoff area 29 (FIG. 2) with an opening 31 defined therein and through which the yarn is passed. This pickup or takeoff area of each of the needles defines the area or point at which the looper assemblies 25 of the looper or hook modules 10 of the present invention will engage the needles to pick and pull the loops 26 of yarns therefrom.

As generally illustrated in FIGS. 1, and 2 and 4A-4B, in one embodiment, each of the looper or hook modules 10 formed according to the principles of the present invention will include a module body 35 generally formed from a high-strength material such as steel or other, similar metal, with the features of each module body being formed by a machining process, such as an electrical discharge machining process. Each module body can have a gauging tab 36 projecting from one side thereof. This gauging tab 36 generally serves to mount the looper module 10 along a gauge bar 37 (FIG. 2) with a series of looper or hook modules being mounted along the gauge bar as indicated in FIGS. 1 and 3. The gauging tabs 36 of each of the module bodies can engage and fit over the module bar 37 and can be secured with a fastener such as a set screw 38, or various other types of fasteners, passing through the gauging tab and into the gauge bar 37 for securing the looper modules to the gauge bar as indicated in FIG. 2. The gauge bar itself further will be mounted to a looper drive system or mechanism 39 for reciprocating the gauge bar, and thus the looper or hook modules mounted thereto, in the direction of arrows 41 and 41', as shown in FIG. 2 for engaging the needles 21A and 21B for picking and pulling the loops of yarns 26 therefrom for forming the chain-stitches or tufts 11 in the backing material 13.

As further generally illustrated in FIGS. 4A and 4B, each module body 35 generally will include a main body portion 42 having a substantially flat upper surface 43 in which a series of slotted openings or grooves 44 are formed at spaced intervals. Each of the slotted openings 44 generally will extend substantially through the main body portion 42 of each module body and will be adapted to receive a portion of a looper assembly 25 therethrough. The slotted openings generally can be substantially straight, or can have additional features such as an expanded opening 46 at one end, as needed or desired to facilitate receipt of the looper assemblies therein. In addition, each module body further will include a looper support 47 typically formed along a downstream or rear side 48 of the module body. A series of vertically extending support slots, recesses or other, similar openings 49 are shown in FIG. 4B as being formed in the looper support 47. Each of the support slots 49 also can be formed at a spacing approximately equivalent to the spacing of the slotted openings 44 formed in the main body portion of the module body, as indicated in FIG. 4B, with each of the support slots 49 being substantially aligned with a corresponding one of the slotted openings 44. The looper support 47 generally will be extended upwardly from the main body portion by a distance sufficient to provide adequate support for portions of each looper assembly, without unduly restricting flexibility, movement or otherwise interfering with the operation thereof.

As shown in FIGS. 4A-6, each of the looper assemblies 25 generally includes a main or primary looper or hook 51, a first transfer looper or hook 52 and a second transfer looper or hook 53. Each primary looper 51 generally will include an elongated body 54 including a lower body portion shank 56 and an upper body portion 57. As shown in FIG. 5B, the upper body portion 57 of the body 54 of the primary looper 51 generally has a substantially U-shaped configuration, including a first or loop pile looper portion or section 58 and a pattern looper section or portion 59 spaced therefrom. Each loop pile looper 58 generally can extend forwardly and upwardly from the main body portion, terminating in a loop pile looper throat 61 having a pointed edge or bill 62 and including a recessed area 63 as shown in FIG. 5B. Each of the pattern loopers 59 further will project upwardly from the upper body portion 57 of the primary looper 51, terminating at a curved or hooked pattern looper throat 64 having a pointed edge or bill 66 at the end thereof, and which generally is aligned substantially parallel to the loop pile looper throat 61 of its primary looper.

The first and second transfer loopers generally are shown in FIGS. 4A-6 as being mounted or affixed to the upper body portion 57 of the body 54 of each primary looper 51 in one exemplary embodiment. Other mounting arrangements whereby the first and second transfer loopers are mounted substantially adjacent and move with the upper body section of each primary looper of each of the looper assemblies 25 also can be used. In the embodiment illustrated in FIGS. 4A-6, the first transfer looper 52 can comprise a stationary looper that will be mounted to the upper body portion and to the pattern looper section of each primary looper in a substantially fixed position, as indicated in FIG. 5B. For example, both of the first and second transfer loopers can be mounted by one or more rivets, screws, bolts or other, similar fasteners 67A/67B to the upper body portion 57 of each primary looper, while an additional fastener 68, such as a rivet, screw, bolt or other, similar fastener generally can be used to secure or affix the first transfer looper to the pattern looper adjacent upper portions thereof so as to mount the first transfer looper 52 in a substantially stationary or fixed position with respect to the primary looper 51. These fasteners further can provide additional support for adjacent looper assemblies during operation of the looper or hook modules, as well as helping to maintain spacing between adjacent looper assemblies along the looper or hook modules, by engagement of their head portions 67A' and 67B' with such adjacent looper assemblies as indicated in FIG. 4B.

Figure 5A:
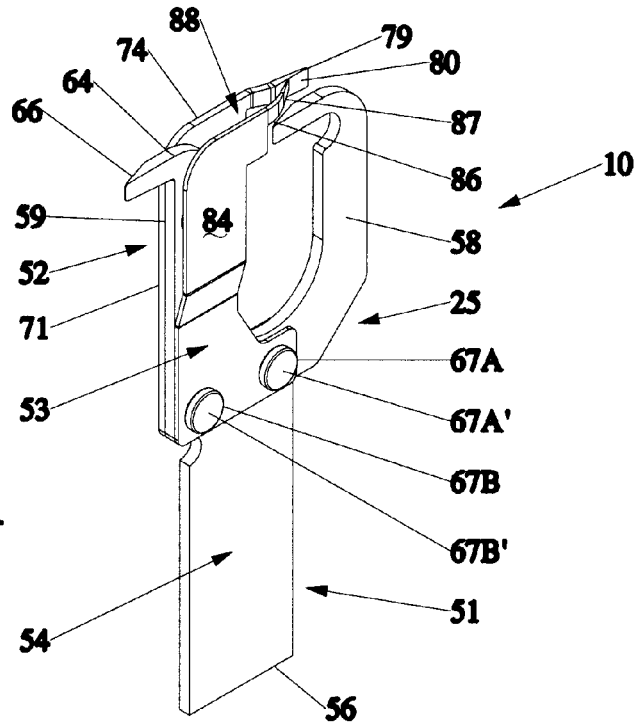
FIG. 5A is perspective illustrating of one embodiment of a chain-stitch looper assembly such as shown in FIGS. 4A and 4B. according to the principles of the present invention.
Figure 5B:
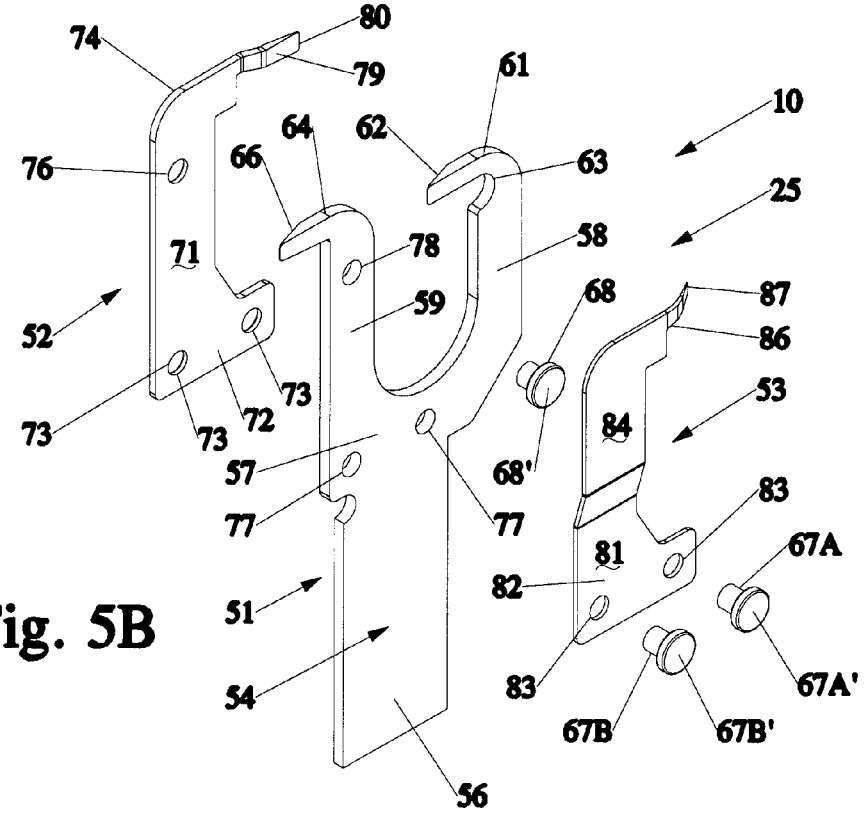
FIG. 5B is an exploded perspective view of the chain-stitch looper assembly of FIG. 5A.
Figure 7A:
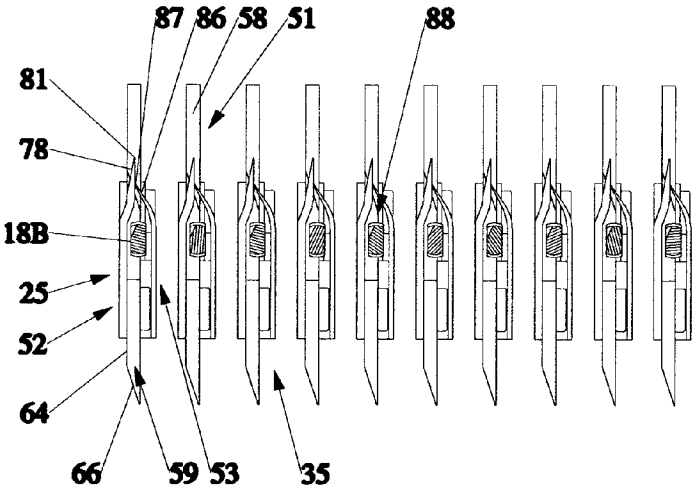
FIG. 7A is a top plan view of the looper module with needles engaged therein as illustrated in FIG. 6.
Figure 7B:
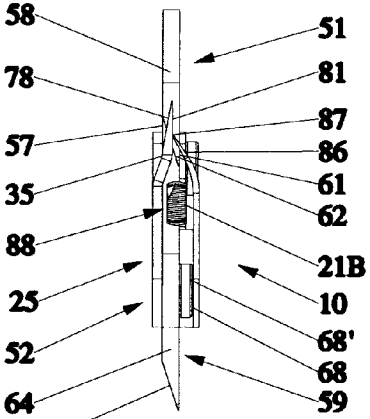
FIG. 7B is a top plan view of one of the looper assemblies of FIG. 6, illustrating the engagement of a needle within an opening defined within the looper assembly.

As further illustrated in FIG. 5B, the first transfer loopers 52 generally each will include a substantially U or C-shaped body 71 having a lower portion 72 including fastener openings 73 for receipt of the fasteners 67A/67B therethrough, and an upper portion 74 having a fastener opening 76 formed therein for receipt of the fastener 68 therethrough. The fastener openings 73 and 76 generally will be aligned with corresponding fastener openings 77 and 78 of the pattern looper of the primary looper 51 to which each first transfer looper is attached. The upper portion 74 of the first transfer looper 52 terminates in a forwardly extending transfer looper throat 79 having an inwardly projecting bill or engaging section 80 at the end thereof.

The second transfer looper 53 similarly includes a body 81 having a lower portion 82 including fastener openings 83 through which the fasteners 67A/67B are received and which align with fastener openings 77 and 73 of the primary looper 51 and first transfer looper 52 as indicated in FIG. 5B. As FIGS. 4A-5A and 6A-7B illustrate, the upper body portion 84 of the second transfer looper generally will be formed with an outwardly projecting or canted configuration, so as to be spaced from the primary looper, and generally will remain unattached to the primary looper. As a result, the upper body portion 84 of the second transfer looper can flex or move and thus can be an elastic looper to facilitate movement of the needles into and out of engagement with the loop pile looper sections of the primary loopers. The head 68' of the fastener 68 attaching the first or stationary transfer looper to its associated primary looper additionally can act as a stop or guide for the upper body section 84 of the second or elastic transfer looper 53 to prevent the second or elastic transfer looper from pinching or otherwise undesirably engaging and holding the yarns on a needle engaged by the looper assembly during pickup. The upper body section or portion 84 of each second or elastic transfer looper further will terminate at a forwardly projecting throat 86 that terminates in an inwardly extended bill 87 that projects toward the loop pile looper throat 61 of the loop pile looper 58 of the primary looper, in similar fashion to the bill 81 of the throat 79 of the first or stationary transfer looper 52.

As indicated in FIGS. 4A, 4B and 5A-7, the throat portions 79 and 86 of the first and second transfer loopers create a window or pocket 88 providing an opening within which the needles 21B (FIGS. 6-7B) are received, and which further helps to open up the loops of yarns picked up and retained on the loop pile looper throats of the primary loopers to enable the needles to pass therethrough to form the chain-stitch tufts 11, as indicated in FIG. 2. The attachment of the first and second transfer loopers to the loop pile looper body further can provide additional strength and support for the looper assembly, with the body of the primary looper further typically being formed with a thickened construction to enable larger loops to be formed for transfer and to provide further strength and rigidity. The upper body section of the second or elastic transfer looper further could be made with a thinner construction to facilitate its flexing when the needle exits the pickup window defined between the throats of the first and second transfer loopers.

As indicated in FIG. 4B, each looper assembly 25 generally will be received within one of the corresponding slotted openings 44 formed in the main body portion 42 of its associated module body 35. The shank portion 56 of each primary looper generally will be received and extend through the main body portion of the module body, with the bottom or lower ends of 72' and 82' of the first and second transfer loopers potentially acting as a guide or stop to prevent further movement of the looper assemblies through the slotted openings of the module body. As further illustrated in FIGS. 4A and 4B, the loop pile loopers of each primary looper further will be at least partially received within a corresponding looper support slot or recess 49 of the looper support portion 47 of each module body 35 so as to provide further strength and support for the loop pile loopers of each looper assembly received therein.

As shown in FIG. 4B, the looper assemblies 25 can be releasably secured within the bodies 35 of their open modules 10 by the movement of an insert or bearing plate 90 into a laterally extending passage 91 formed through the main body portion of each module body, and which insert 90 thereafter can be secured or locked in place with one or more set screws 92 or other, similar fasteners. The insert 90 thus will be held in frictional or bearing engagement against the shank portions of each of the primary loopers of each looper assembly so as to affix or hold the looper assemblies within their module blocks. In the event of a damaged or broken or worn looper assembly, the set screw(s) 92 can be removed and the insert released from its bearing engagement against the shank portions of the primary loopers of the looper assemblies. Thereafter, the broken or worn looper assembly can be removed and a new looper assembly inserted in its place into the module body. The insert can then be reengaged into its frictional or bearing engagement with the looper assemblies to re-secure the looper assemblies within the module body. The assembled looper or hook modules 10 thereafter can be mounted in series along the gauging bar as indicated in FIGS. 1-3.

Figure 6:
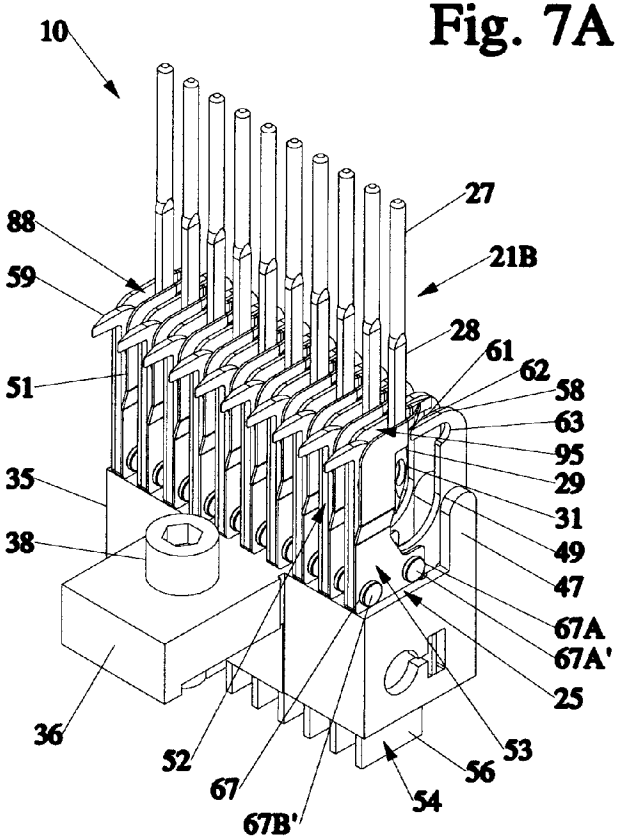
FIG. 6 is a perspective illustration illustrating the engagement of a series of needles with the chain-stitch looper assemblies of the looper module of FIGS. 5A-5B.

In operation of the looper or hook module 10 for forming chain-stitch or perma-stitch type fabrics according to the principles of the present invention, as indicated in FIGS. 2 and 6, as the needles penetrate the backing material 13, carrying the yarns Y1 and Y2 therewith, each of the downstream needles 21B will enter the pocket or window 88 defined between the first and second transfer loopers. As the looper or hook module is reciprocated in the direction of arrow 41 (FIG. 2), the loop pile loopers of each of the looper assemblies generally will engage and pick up a loop of yarn along their throats 61. As the needles are reciprocated out of engagement with the looper assemblies and back through the backing material, the loops formed on the throats of each of the loop pile loopers will be transferred to the throat portions of the first and second transfer loopers. The first and second transfer loopers will spread or open the loop of yarn transferred thereto apart as the looper assemblies are reciprocated back toward engagement with the needles.

As the needles again are reciprocated through the backing material, the needles will enter the window or pocket created between the first and second transfer loopers and further will pass through the open loop of yarn being held on the throat portions of the first and second transfer loopers. As a result, a chained stitch, in which the loops of yarns are interlocked in series, will be formed. Thereafter, as the needle is reciprocated along the second or return half of its cycle, moving toward a raised, non-engaging position out of the backing material, the second or elastic transfer looper body will flex so as to enable the needle to exit without binding or otherwise impeding the movement of the needle out of the window or pocket defined between the first and second transfer loopers, as an additional loop of yarn is formed on the loop pile looper throat of the primary looper as the tufting process is repeated to form multiple chain stitches.

As additionally indicated in FIG. 2, the upstream yarns Y1 carried by the upstream needles 21A further can be selectively engaged by the pattern loopers 59 of each of the looper assemblies 25 to form loop pile tufts in the backing material. These additional loop pile tufts can be used to form additional patterning effects or other visual effects or appearances in the backing material.

The looper or hook module according to the principles of the present invention thus enable the formation of chain-stitch or "perma-stitch" type tufted fabrics such as carpets or other, similar tufted fabrics which is designed to provide enhanced consistency and longevity of the life of the looper assemblies used therein. The construction of the looper or hook module enables a more robust, supported construction for the looper portions or sections of the looper assemblies thereof to provide enhanced positional accuracy of the transfer loopers with respect to the loop pile looper throat and adding strength to the looper assembly, while helping to minimize potential pinching or unnecessary engagement of the yarns on the needles as the needles are passed into and out of engagement with the loop pile looper throats of the looper assemblies. In addition, the engagement and supporting of the loop pile loopers of the looper assemblies within the looper support portions or sections of the module bodies can provide further rigidity and positional stability to the loop pile looper throats thereof to enhance accuracy in achieving cleaner pickup of yarns from the needles.

The foregoing description generally illustrates and describes various embodiments of the present invention. However, it will be understood by those skilled in the art that various changes can be made to the above-discussed construction without departing from the spirit and scope of the present invention as disclosed herein, and that it is further intended that all matter contained in the above description or shown in the accompanying drawings shall be interpreted as illustrative, and not in a limiting sense. Furthermore, the scope of the present disclosure shall be construed to cover various modifications, combinations, alterations, etc., of the above-described embodiments, which shall be considered to be within the scope of the present invention. Accordingly, various features and characteristics of the present invention as discussed herein may be selectively interchanged and applied to other illustrated and non-illustrated embodiments of the present invention.

What is claimed:

1. A looper assembly for forming chain stitch tufted articles, comprising:

a primary looper including a loop pile looper throat;

a first transfer looper having a throat adjacent said loop pile looper throat; and a second transfer looper having a throat adjacent said loop pile looper throat;

wherein an opening is defined between said first and second transfer loopers adjacent said loop pile looper throat, enabling passage of a needle therethrough for formation of a loop of yarn on said loop pile looper throat.

2. The looper assembly of claim 1, wherein said primary looper and said first and second transfer loopers are coupled together to define a substantially unitary looper structure.

3. The looper assembly of claim 1 wherein said first transfer looper comprises a stationary looper attached to said primary looper adjacent a lower end thereof and along an intermediate portion thereof.

4. The looper assembly of claim 1, wherein said second transfer looper comprises an elastic looper attached to said primary looper adjacent a lower end thereof.

5. The looper assembly of claim 1, further comprising a module having a body with a slotted opening adapted to receive said primary looper within said body, with said first and second transfer loopers supported by said primary looper so as to define a substantially unitary looper structure mounted within said module.

6. The looper assembly of claim 5, wherein said module further comprises a looper support section having an upwardly extending opening adapted to receive a loop pile looper body portion of said primary looper.

7. The looper assembly of claim 5, wherein said module further comprises a removable insert received within said body and which engages said unitary looper structure for releasably mounting said unitary looper structure within said module.

8. The looper assembly of claim 1, wherein said second transfer looper comprises a thickness less than a thickness of said first transfer looper.

9. The looper assembly of claim 1, said primary looper further comprising a shank portion, an upper body portion, a loop pile looper projecting from said upper body portion and terminating in said loop pile looper throat, and a pattern looper portion projecting from said intermediate portion, spaced from said loop pile looper and terminating in a pattern looper throat.

10. The looper assembly of claim 1, further comprising at least one fastener for attaching said primary looper to at least one of said first transfer looper and said second transfer looper, said at least one fastener having a shank and a head portion adapted to engage and support an adjacent looper assembly.

11. The looper assembly of claim 1, further comprising a series of fasteners, including a first fastener engaging and connecting said primary looper and a portion of said first transfer looper, and a second fastener engaging and connecting said primary looper to said first and second transfer loopers adjacent lower ends thereof, wherein said primary looper and said first and second transfer loopers are attached to define a substantially unitary looper structure with an upper body portion and said throat of said second transfer looper being movable toward and away from said loop pile looper throat of said primary looper.

12. A method of forming a tufted article, comprising:

feeding a backing material along a path of travel beneath a series of needles;

penetrating the backing material with the needles and delivering a series of yarns into the backing material;

receiving the needles into engagement with a series of looper assemblies, each of the looper assemblies including a primary looper having a loop pile looper, a first transfer looper, and a second transfer looper, with pockets defined between each of the first and second transfer loopers adjacent the loop pile looper of their primary looper receiving the needles therein;

picking the yarns from the needles and forming loops of yarns on the loop pile loopers of the primary loopers of the looper assemblies;

transferring the loops of yarns from the loop pile loopers to the first and second transfer loopers; and as the needles are reciprocated back into engagement with the looper assemblies moving the needles through the loops of yarns transferred to the first and second transfer loopers and engaging and picking next loops of yarns from the needles with the loop pile loopers for forming a chain of stitches in the backing material.

13. The method of claim 12, further comprising opening the loops of yarns transferred to the first and second transfer loopers for movement of the needles through the loops of yarns.

14. The method of claim 12, further comprising flexing one of the first and second transfer loopers as the needles exit the pockets defined therebetween.

15. A tufting machine, comprising:

at least one yarn feed mechanism feeding yarns to each of the needles;

a backing feed mechanism feeding a backing material along a path of travel for engagement by the needles to form tufts of yarns therein; and a series of chain stitch looper assemblies below the path of travel of the backing material and adapted to engage and pick loops of yarns from the needles, each of the chain stitch looper assemblies comprising:

a primary looper having a loop pile looper including a throat; and a pair of transfer loopers mounted along the primary looper to form a substantially unitary looper structure;

wherein the transfer loopers define a pocket adjacent the throat of the loop pile looper portion of the primary looper to facilitate movement of a needle between the transfer loopers for engagement of the needle and formation of a loop of yarn along the throat of the loop pile looper portion of the primary looper.

16. The tufting machine of claim 15, further comprising a module having a body with a series of slotted openings, each adapted to receive a portion of one of the primary loopers of each looper assembly, and a looper support having upwardly extending slots for receiving and supporting the loop pile loopers of the primary loopers.

17. The tufting machine of claim 15, further comprising a series of fasteners, including a first fastener engaging and connecting said primary looper and a portion of the first transfer looper, and a second fastener engaging and coupling the primary looper to the first and second transfer loopers adjacent lower ends thereof, to form each substantially unitary looper structure wherein an upper body portion and throat of the second transfer looper are movable toward and away from the throat of the loop pile looper of the primary looper.

18. The tufting machine of claim 15, wherein the primary looper further comprises a shank portion, an upper body portion, from which the loop pile looper projects and terminates in the loop pile looper throat, and a pattern looper portion projecting from said intermediate portion, spaced from said loop pile looper and terminating in a pattern looper throat.

19. The tufting machine of claim 18, wherein each second transfer looper comprises a thickness less than a thickness of each first transfer looper; and wherein the second transfer loopers each include an upper body portion terminating in a transfer looper throat that is movable toward and away from the throat of the loop pile looper of the primary looper, and wherein the upper body portion of the second transfer looper is adapted to flex and move with respect to the primary looper, as the needles move out of engagement with the looper assemblies.

* * * * *